US008814585B2

(12) United States Patent
Yu et al.

(10) Patent No.: US 8,814,585 B2
(45) Date of Patent: Aug. 26, 2014

(54) ELECTRICAL CONNECTOR HAVING A POSITIONING PROTRUSION WITH A SLANTED GUIDING SURFACE

(71) Applicant: Alltop Electronics (Suzhou) Ltd., Taicang (CN)

(72) Inventors: Wang-I Yu, Jhonghe (TW); Shuang-Feng Li, Taicang (CN); Li-Li Liang, Taicang (CN)

(73) Assignee: Alltop Electronics (Suzhou) Ltd., Taicang (CN)

( * ) Notice: Subject to any disclaimer, the term of this patent is extended or adjusted under 35 U.S.C. 154(b) by 26 days.

(21) Appl. No.: 13/746,720

(22) Filed: Jan. 22, 2013

(65) Prior Publication Data

US 2014/0134885 A1 May 15, 2014

(30) Foreign Application Priority Data

Nov. 9, 2012 (CN) ..... 2012 1 0446072

(51) Int. Cl.
*H01R 13/64* (2006.01)

(52) U.S. Cl.
USPC ..... 439/247

(58) Field of Classification Search
USPC ..... 439/246–249, 377–378, 677
See application file for complete search history.

(56) References Cited

U.S. PATENT DOCUMENTS

| | | | | | |
|---|---|---|---|---|---|
| 4,812,133 | A | * | 3/1989 | Fleak et al. | 439/248 |
| 5,197,896 | A | * | 3/1993 | Landis et al. | 439/247 |
| 5,211,585 | A | * | 5/1993 | Douty et al. | 439/680 |
| 5,213,518 | A | * | 5/1993 | Weidler | 439/211 |
| 5,228,865 | A | * | 7/1993 | Douty et al. | 439/247 |
| RE34,430 | E | * | 11/1993 | Mosquera et al. | 439/248 |
| 6,290,536 | B1 | * | 9/2001 | Hwang et al. | 439/553 |
| 7,887,350 | B2 | * | 2/2011 | Fukazawa et al. | 439/247 |

* cited by examiner

*Primary Examiner* — Chandrika Prasad
(74) *Attorney, Agent, or Firm* — Sughrue Mion, PLLC

(57) ABSTRACT

An electrical connector mountable on a printed circuit board and adapted for mating with a complementary connector, includes an insulating housing and a plurality of contacts. The insulating housing defines a base section, an upper and a lower walls extending forwardly from the base section, and a receiving space defined between the upper and the lower walls. Each contact has a main portion, a contacting portion extending from the main portion and exposed to the receiving space, and a tail portion extending outside of the insulating housing. A positioning protrusion is formed on an inside face of the lower wall and extends into the receiving space, and defines a slanted guiding surface therealong opposing to the upper wall to guide an insertion or rejection of the complementary connector.

14 Claims, 6 Drawing Sheets

ELECTRICAL CONNECTOR HAVING A POSITIONING PROTRUSION WITH A SLANTED GUIDING SURFACE

BACKGROUND OF THE INVENTION

1. Field of the Invention

The present invention relates to an electrical connector, and more particularly, to an electrical connector mountable on a printed circuit board.

2. Description of Related Art

Conventional plug and receptacle connectors usually engage with each other along a horizontal direction. When there is a need to pull the plug connector out from the receptacle connector, which is mounted on a printed circuit board, a relative large rejecting space on such a printed circuit board is therefore required. However, with the development of smaller electronic devices, space occupied by disassembling mated plug and receptacle connectors should also be designed smaller.

Hence, an electrical connector mountable on a printed circuit board with improved insulating housing is desired.

BRIEF SUMMARY OF THE INVENTION

The present invention provides an electrical connector mountable on a printed circuit board and adaptable for mating with a complementary connector. The electrical connector includes an insulating housing and a plurality of contacts. The insulating housing defines a base section, an upper wall and a lower wall extending forwardly from opposite upper edge and lower edge of the base section, and a receiving space defined between the upper wall and the lower wall. Each contact has a main portion retained in the insulating housing, a contacting portion extending from the main portion and exposed to the receiving space, and a tail portion extending outside of the insulating housing. A positioning protrusion is formed on an inside face of the lower wall and extends into the receiving space, and defines a slanted guiding surface therealong opposing to the upper wall to guide an insertion or rejection of the complementary connector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
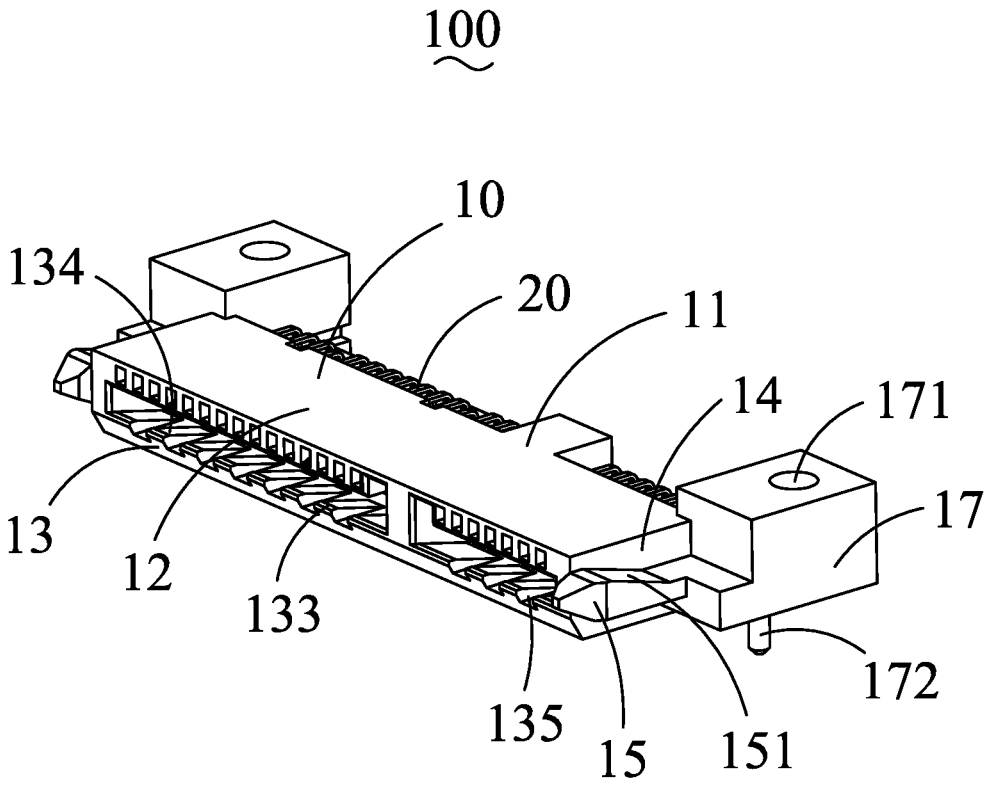
FIG. 1 is a perspective view of an electrical connector in accordance with the present invention.

Reference will now be made to the drawing figures to describe the embodiments of the present invention in detail. In the following description, the same drawing reference numerals are used for the same elements in different drawings.

Figure 2:
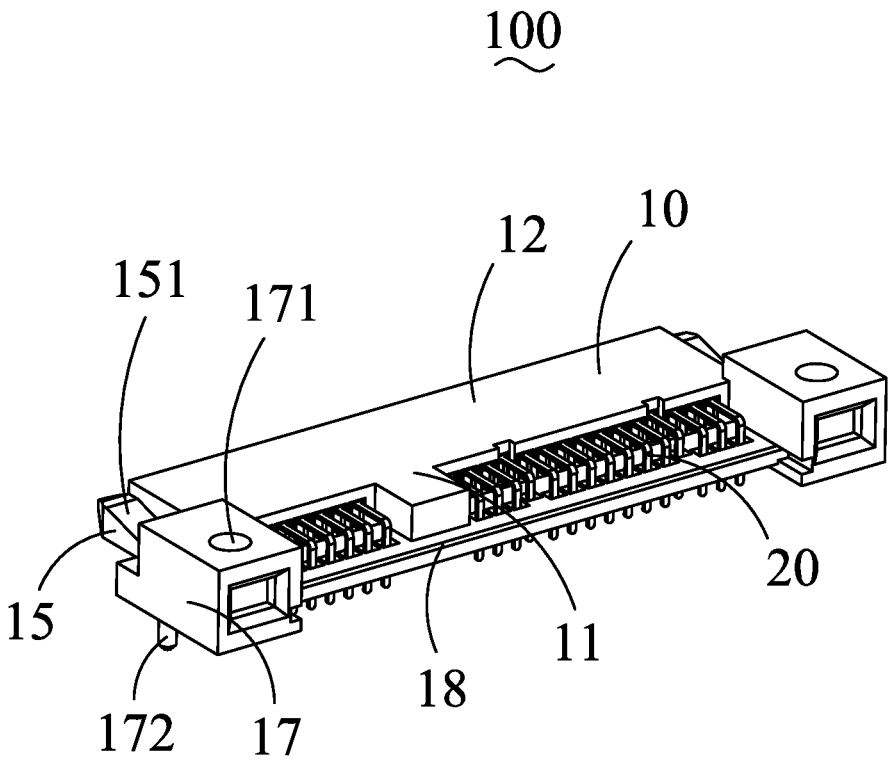
FIG. 2 is a perspective view of the electrical connector as shown in FIG. 1 while taken from another aspect.
Figure 3:
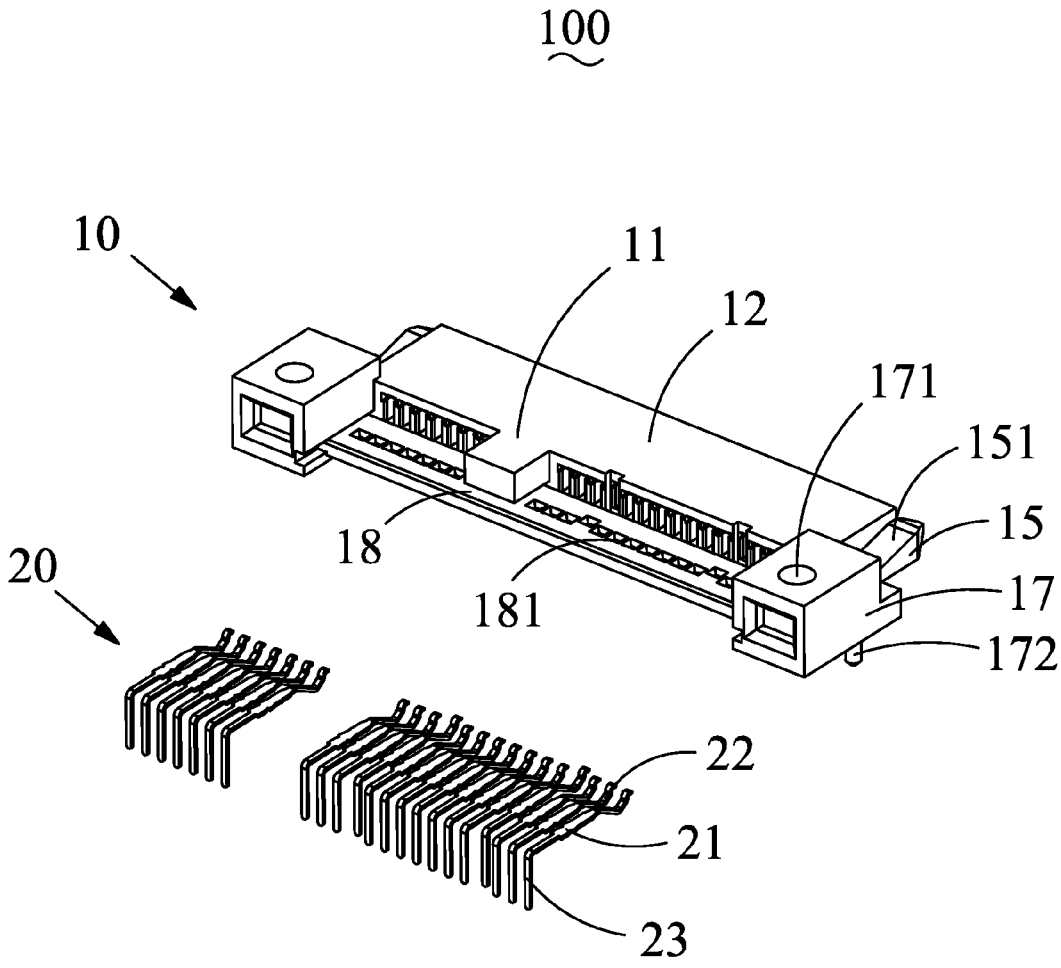
FIG. 3 is an exploded, perspective view of the electrical connector.

Referring to FIGS. 1 to 3, the present invention discloses an electrical connector 100 mountable on a printed circuit board (not shown) and matable with a complementary connector 200. The electrical connector 100 includes an insulating housing 10 and a plurality of contacts 20 retained in the insulating housing 10.

Figure 4:
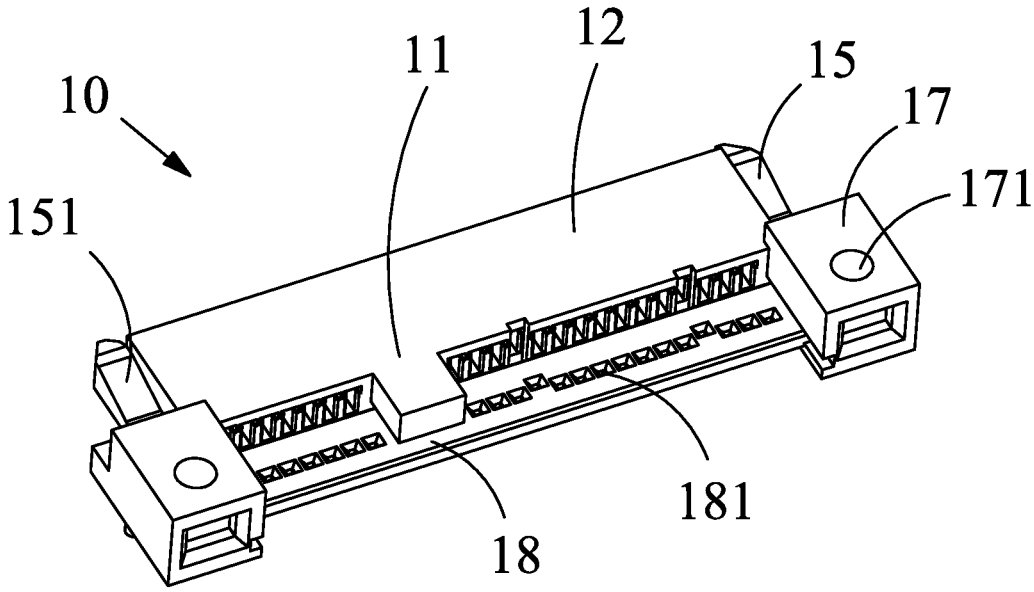
FIG. 4 is a perspective view of an insulating housing of the electrical connector.
Figure 5:
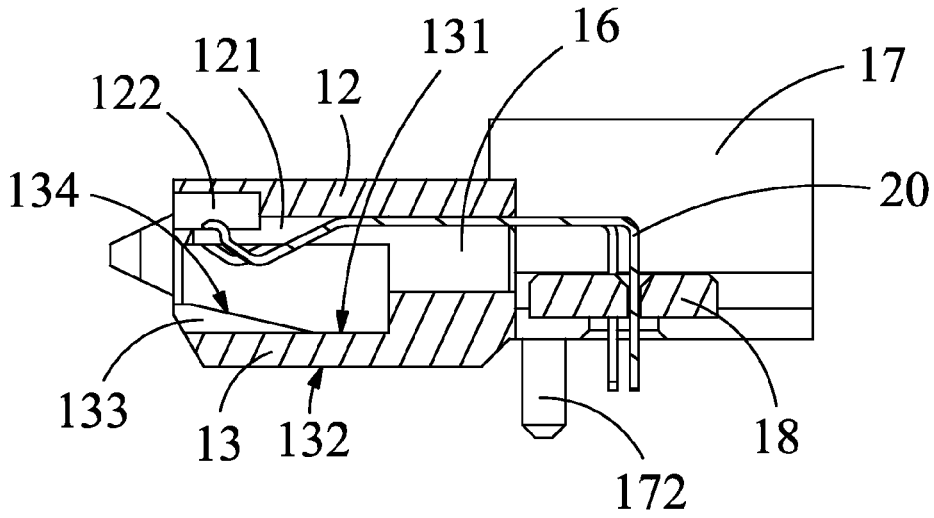
FIG. 5 is a cross-sectional view of the electrical connector.

Referring to FIG. 4 together with FIGS. 1 and 5, the insulating housing 10 comprises a base section 11, an upper wall 12 and a lower wall 13 extending forwardly from opposite upper edge and lower edge of the base section 11, and a pair of lateral walls 14 connecting the upper wall 12 and the lower wall 13. A receiving space 16 is such defined between the upper wall 12, the lower wall 13 and the pair of lateral walls 14. The insulating housing 10 provides a pair of guiding posts 15 at opposite sides thereof along a transversal direction and located besides the base section 11. Each guiding post 15 has a slanted guiding face 151 formed therewith. A pair of mounting sections 17 is formed on the insulating housing 10 which extend rearwards from opposite sides of the base section 11. The insulating housing 10 also provides a spacer 18 extending between the pair of mounting sections 17. In the preferred embodiment, the spacer 18 is integrally formed with the insulating housing 10. The mounting section 17 defines a mounting hole 171 extending therethrough along a thickness direction of the electrical connector 100 and a mounting post 172 extending downwards towards the printed circuit board on which the electrical connector is mounted. The spacer 18 of the insulating housing 10 defines a plurality of through holes 181 for receiving corresponding parts of the contacts 20. In the preferred embodiment, the receiving space 16 of the insulating housing 10 has two receiving rooms (not labeled) separated by a dividing wall (not labeled). The two receiving rooms are configured to receive two groups of contacts.

The insulating housing 10 defines a plurality of passageways 121 disposed on the upper wall 12 and communicating with the receiving space 16. A plurality of grooves 122 are also defined on the upper wall 12 which are communicating to corresponding passageways 121. The lower wall 13 has an inside face 131 and an outside face 132 opposite to the inside face 131. A plurality of positioning protrusions 133 are formed on the inside face 131 of the lower wall 13. Each of the positioning protrusions 133 has a slanted guiding surface 134 formed thereon which is opposite to the upper wall 12. The positioning protrusions 133 protrude into the receiving space 16. The thickness of the positioning protrusion 133 decreases along an insertion direction of the complementary connector 200 which is a substantial front-to-back direction. The slanted guiding face 151 of the guiding post 15 is parallel to the slanted guiding surface 134 of the positioning protrusion 133. The slope of eh slanted guiding face 151 is same to the slope of the slanted guiding surface 134. In the preferred embodiment, there are a plurality of recesses 135 recessed from the slanted guiding surfaces 134 thereof. In other embodiment, the number of the positioning protrusions can be changed. For example, there can be one positioning protrusion extending between the lateral walls along a transversal direction of the electrical connector.

Referring to FIGS. 3 and 5, each contact 20 comprises a main portion 21, a contacting portion 22 extending from the main portion 21 and exposed to the receiving space 16, and a tail portion 23 extending to outside of the insulating housing 10. In the preferred embodiment, the tail portion 23 is bent to be perpendicular to the contacting portion 22 and is inserted through the through hole 181 of the spacer 18 to thereby be soldered to the printed circuit board. The contacting portion 22 has a distal end moveably retained in the groove 122 to thereby secure the contacting portion 22 within the passageway 121. Each contacting portion 22 extends partially to the receiving space 16 to electrical connect to the complementary connector 200.

Figure 6:
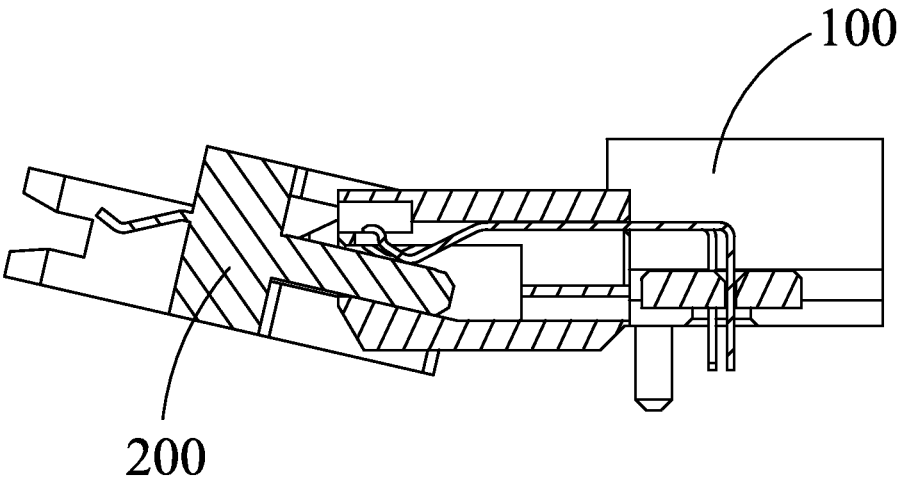
FIG. 6 is cross-sectional view of the electrical connector which is mating with a complementary connector.

Referring to FIG. 6, the engagement between the electrical connector 100 of the present invention and the complementary connector 200 is shown. When the complementary connector 200 is inserted into or rejected from the receiving space 16 of the electrical connector 100, the positioning protrusion 133 guides the complementary connector 200 to insert/reject along the slanted guiding surface 134 thereof. Obviously, comparing to the horizontal insertion/rejection, the space on the printed circuit board, where the electrical connector 100 is mounted, is saved.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

We claim:

1. An electrical connector mountable on a printed circuit board and adaptable for mating with a complementary connector, comprising:

an insulating housing defining a base section, an upper wall and a lower wall extending forwardly from opposite upper edge and lower edge of the base section, and a receiving space defined between the upper wall and the lower wall; and a plurality of contacts received in the insulating housing, each contact comprising a main portion retained in the insulating housing, a contacting portion extending from the main portion and exposed to the receiving space, and a tail portion extending outside of the insulating housing; wherein a positioning protrusion is formed on an inside face of the lower wall and extends into the receiving space; wherein the positioning protrusion defines a slanted guiding surface therealong opposing to the upper wall.

2. The electrical connector as claimed in claim 1, wherein the thickness of the positioning protrusion decreases along an insertion direction of the complementary connector.

3. The electrical connector as claimed in claim 2, wherein the positioning protrusion has a plurality of recesses recessed from the slanted guiding surface thereof.

4. The electrical connector as claimed in claim 2, wherein the insulating housing further comprises a pair of lateral walls connecting the upper wall and the lower wall and wherein the receiving space is surrounded by the upper wall, the lower wall and the pair of lateral walls.

5. The electrical connector as claimed in claim 4, wherein the positioning protrusion extends between the pair of lateral walls.

6. The electrical connector as claimed in claim 4, wherein the insulating housing defines a plurality of passageways disposed on the upper wall and communicating with the receiving space and wherein the contacting portions of the contacts are retained within the passageway and partially exposed to the receiving space for connecting with the complementary connector.

7. The electrical connector as claimed in claim 6, wherein the insulating housing defines a groove communicating to each of the passageway and wherein each contacting portion has a distal end moveably received in corresponding groove to thereby secure the contacting portion in the passageway.

8. The electrical connector as claimed in claim 4, wherein the insulating housing provides a pair of guiding posts at opposite sides thereof along a transversal direction and wherein each guiding post has a slanted guiding face.

9. The electrical connector as claimed in claim 8, wherein the slanted guiding face of the guiding post is parallel to the slanted guiding surface of the positioning protrusion.

10. The electrical connector as claimed in claim 1, wherein the insulating housing defines a pair of mounting sections extending rearwards from the base section.

11. The electrical connector as claimed in claim 10, wherein each mounting section of the insulating housing defines a mounting hole extending therethrough along a thickness direction of the electrical connector and a mounting post extending downwards towards the printed circuit board on which the electrical connector is mounted.

12. The electrical connector as claimed in claim 11, further comprising a spacer which defines a plurality of through holes therethrough for receiving and positioning the tail portions of the contacts.

13. The electrical connector as claimed in claim 12, wherein the spacer is integrally formed with the insulating housing and extends between the pair of mounting sections.

14. The electrical connector as claimed in claim 12, wherein the receiving space has at least two receiving rooms separated by a dividing wall which are configured to receive at least two groups of contacts.

* * * * *